US009488021B2

(12) United States Patent
Salvador et al.

(10) Patent No.: US 9,488,021 B2
(45) Date of Patent: Nov. 8, 2016

(54) QUICKLY RECONFIGURABLE CORE BARREL HEAD ASSEMBLY

(75) Inventors: Patrick Salvador, North Bay (CA); Dennis Groulx, Astorville (CA); Paul Lambert, North Bay (CA)

(73) Assignee: ATLAS COPCO CANADA INC, Dollard-des-Ormeaux (CA)

( * ) Notice: Subject to any disclaimer, the term of this patent is extended or adjusted under 35 U.S.C. 154(b) by 0 days.

(21) Appl. No.: 13/818,757

(22) PCT Filed: Aug. 30, 2010

(86) PCT No.: PCT/CA2010/001358

§ 371 (c)(1),
(2), (4) Date: Feb. 25, 2013

(87) PCT Pub. No.: WO2012/027817

PCT Pub. Date: Mar. 8, 2012

(65) Prior Publication Data

US 2013/0146365 A1 Jun. 13, 2013

(51) Int. Cl.

| | |
|---|---|
| ***E21B 25/02*** | (2006.01) |
| ***E21B 25/00*** | (2006.01) |
| ***E21B 17/02*** | (2006.01) |
| ***E21B 23/02*** | (2006.01) |

(52) U.S. Cl.

CPC ..... *E21B 25/00* (2013.01); *E21B 17/023* (2013.01); *E21B 23/02* (2013.01); *E21B 25/02* (2013.01)

(58) Field of Classification Search

CPC ..... E21B 25/00; E21B 25/02
USPC ..... 175/246
See application file for complete search history.

(56) References Cited

U.S. PATENT DOCUMENTS

| | | | | |
|---|---|---|---|---|
| 2,419,738 | A | 4/1947 | Smith | |
| 3,333,647 | A * | 8/1967 | Karich et al. | 175/247 |
| 3,346,059 | A * | 10/1967 | Svendsen | 175/246 |
| 3,485,310 | A * | 12/1969 | Milosevich | 175/246 |
| 4,834,198 | A * | 5/1989 | Thompson | 175/244 |
| 6,019,181 | A * | 2/2000 | Soinski et al. | 175/58 |
| 6,029,758 | A | 2/2000 | Novacovicci et al. | |
| 6,425,449 | B1 | 7/2002 | Marshall | |
| 8,794,355 | B2 * | 8/2014 | Drenth et al. | 175/284 |
| 2004/0065478 | A1 | 4/2004 | Gregory | |
| 2010/0187015 | A1 | 7/2010 | Williams | |
| 2012/0090894 | A1 * | 4/2012 | Laplante | 175/57 |

OTHER PUBLICATIONS

PCT/ISA/210—International Search Report—Mar. 24, 2011 (Issued in PCT/CA2010/001358).
PCT/ISA/237—Written Opinion of the International Searching Authority—Mar. 16, 2011 (Issued in PCT/CA2010/001358).

* cited by examiner

*Primary Examiner* — Robert E Fuller
(74) *Attorney, Agent, or Firm* — Venable LLP; Eric J. Franklin

(57) ABSTRACT

A core barrel head assembly positionable within a drill string of a drilling apparatus. The core barrel head assembly includes an upper latch body having a latch assembly for engageably latching the drill string and a reduced diametric portion below the latch assembly for receiving a seal member. The reduced diametric portion has a lower coupling portion on a bottom portion thereof. The head assembly also includes a lower latch body including an upper coupling portion on a top portion thereof, and a coupler for removably coupling the upper latch body to the lower latch body. The seal member is installable on and removable from the reduced diametric portion upon uncoupling the upper latch body from the lower latch body. The head assembly is quickly reconfigurable between surface and pump in/underground configurations. Core barrel outer tube components also do not require reconfiguring between these two configurations.

12 Claims, 3 Drawing Sheets

QUICKLY RECONFIGURABLE CORE BARREL HEAD ASSEMBLY

CROSS-REFERENCE TO RELATED APPLICATIONS

This application is the national phase under 35 U.S.C. §371 of PCT/CA2010/001358 filed 30 Aug. 2010.

FIELD OF THE INVENTION

The present invention relates to drill head assemblies. More specifically, it relates to a core barrel head assembly that is quickly reconfigurable between surface and pump in/underground configurations while having common parts between the surface and pump in/underground configurations.

BACKGROUND OF THE INVENTION

In core drilling operations, it is often desired to obtain a core sample to obtain geological information on a particular site. This operation is to be ideally accomplished without removing the drill string from the borehole. For this purpose, hollow drill strings have been developed and include a bit end at the end of the drill string and a core barrel unit positioned proximate the coring bit end. The inner tube assembly unit can be transported through the drill string and thus ideally avoid having to remove the complete drill string to obtain a core sample.

However, various drilling applications require the provision of a drilling apparatus where the drill string can be positioned in different orientations. This difference in positioning of the drill string imposes changes to the core barrel components to position the inner tube assembly properly and efficiently to the bit end of the drill string. Changing these core barrel components requires the removal of the entire drill string to gain access to them. This process can be very time consuming and is non-productive. Other drilling situations, such as in an underground mine, require the ability to drill in all orientations. Furthermore, in a down-hole application, the angle of the hole may be deviated to a flatter, horizontal angle, which would require a change to an up-hole configuration of the core barrel to efficiently propel the inner tube assembly to the bit end of the drill string. There is also a need to avoid reconfiguring core barrel outer tube components between surface and pump in/underground configurations.

U.S. Pat. No. 4,834,198 discloses a core barrel apparatus including an inner tube assembly that may fall under gravity or be fluidly propelled to a bit end of a drill string. The seal in this apparatus is interposed between lock nuts threaded on a latch body and a washer. The washer rests against a coil spring urging against a lower tubular member. The seal in such a configuration cannot be removed without affecting the proper interfacing of the remaining components.

U.S. Pat. No. 6,425,449 discloses a drilling apparatus including seals that are mounted on a latch body adaptor component that can be removed to convert from an up-hole to a down-hole configuration.

Consequently, there is still presently a need for a head assembly that is quickly reconfigurable between surface and pump in/underground configurations, easily maintainable on the field and requiring a minimal amount of parts to accomplish the reconfiguration.

SUMMARY OF THE INVENTION

It is an object of the present invention to provide a head assembly that addresses at least one of the above-mentioned needs.

Accordingly, the present invention provides a core barrel head assembly positionable within a drill string of a drilling apparatus, the core barrel head assembly comprising:

- an upper latch body, the upper latch body comprising:
  - a latch assembly for engageably latching the drill string; and
  - a reduced diametric portion below the latch assembly for receiving a seal member, the reduced diametric portion comprising a lower coupling portion on a bottom portion thereof;
- a lower latch body comprising an upper coupling portion on a top portion thereof; and
- a coupler for removably coupling the upper latch body to the lower latch body through the lower coupling portion and the upper coupling portion respectively, wherein the seal member is installable on and removable from the reduced diametric portion upon uncoupling the upper latch body from the lower latch body.

The head assembly according to the present invention provides the following advantages over existing designs that are known to the Applicant:

- common outer tubular parts for surface and pump in/underground configurations;
- minimal addition of parts for conversion from a surface to an underground configuration (although an underground configuration may be used for surface applications); and
- simplified design which is easily maintainable on the field.

BRIEF DESCRIPTION OF THE DRAWINGS

The foregoing summary, as well as the detailed description of the preferred embodiments of the present invention, will be better understood when read in conjunction with the appended drawings. For the purpose of illustrating the invention, there is shown in the drawings, which are diagrammatic, embodiments that are presently preferred. It should be understood, however, that the present invention is not limited to the precise arrangements and instrumentalities shown. In the drawings.

PREFERRED EMBODIMENTS OF THE PRESENT INVENTION

Figure 1:
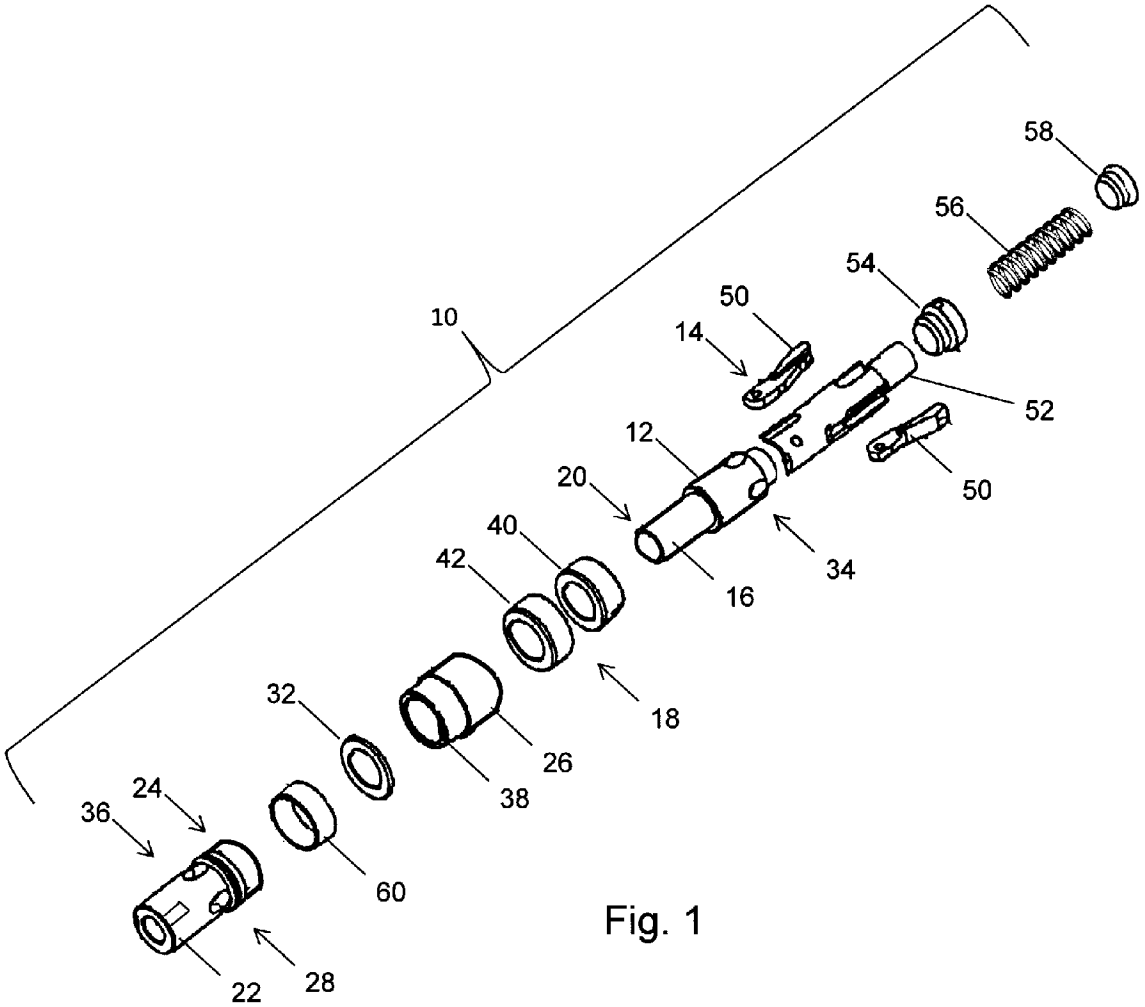
FIG. 1 is an exploded perspective view of the head assembly according to a preferred embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings and are thus intended to include direct connections between two members without any other members interposed therebetween and indirect connections between members in which one or more other members are interposed therebetween. Further, "connected" and "coupled" are not restricted to physical or mechanical connections or couplings. Additionally, the words "lower", "upper", "upward", "down" and "downward" designate directions in the drawings to which reference is made. The words "inner", "inwardly" and "outer", "outwardly" refer to directions toward and away from, respectively, a designated axis or a geometric center of an element being described, the particular meaning being readily apparent from the context of the description. The terminology includes the words specifically mentioned above, derivatives thereof, and words or similar import.

Referring now to the drawings in detail, wherein like numbers are used to indicate like elements throughout, there is shown in FIG. 1 a presently preferred embodiment of an core barrel head assembly 10 for a drilling apparatus.

The core barrel head assembly 10 is positionable within a drill string of a drilling apparatus. The core barrel head assembly 10 comprises an upper latch body 12 having a latch assembly 14 for engageably latching the drill string. The upper latch body 12 also includes a reduced diametric portion 16 below the latch assembly 14 for receiving a seal member 18. The reduced diametric portion 16 has a lower coupling portion 20 on a bottom portion thereof. The head assembly 10 also includes a lower latch body 22 comprising an upper coupling portion 24 on a top portion thereof. The head assembly 10 further includes a coupler 26 for removably coupling the upper latch body 12 to the lower latch body 22 through the lower coupling portion 20 and the upper coupling portion 24 respectively. The seal member 18 is installable on and removable from the reduced diametric portion 16 upon uncoupling the upper latch body 12 from the lower latch body 22.

Preferably, the head assembly 10 further comprises a landing shoulder 60, and a distance between the landing shoulder 60 and the latch assembly 14 is constant after installation or removal of the seal member 18 and through installation of the coupler 26.

Preferably, the lower coupling portion 20 and the upper coupling portions 24 are threaded portions and the coupler 26 is a threaded locking nut, a threaded coupler or bushing or any other equivalent structure. In the embodiment of the present invention shown in FIG. 2, the coupler 26 is a threaded coupler having a reduced diametric portion 38 interfacing with the lower latch body 22. The coupler 26 locks the upper latch body 12 to the lower latch body 22, and locks as well the landing shoulder 60 into position. The coupler 26 facilitates removal of the pumping seal member 18 and the landing shoulder 28 from the upper latch body 12. Therefore, the upper latch body 12 threads into the threaded coupler 26 until it bottoms out, the distance between the landing shoulder 28 and the latch assembly 14 remaining constant whether or not the seal member 18 is installed or not.

Figure 2:
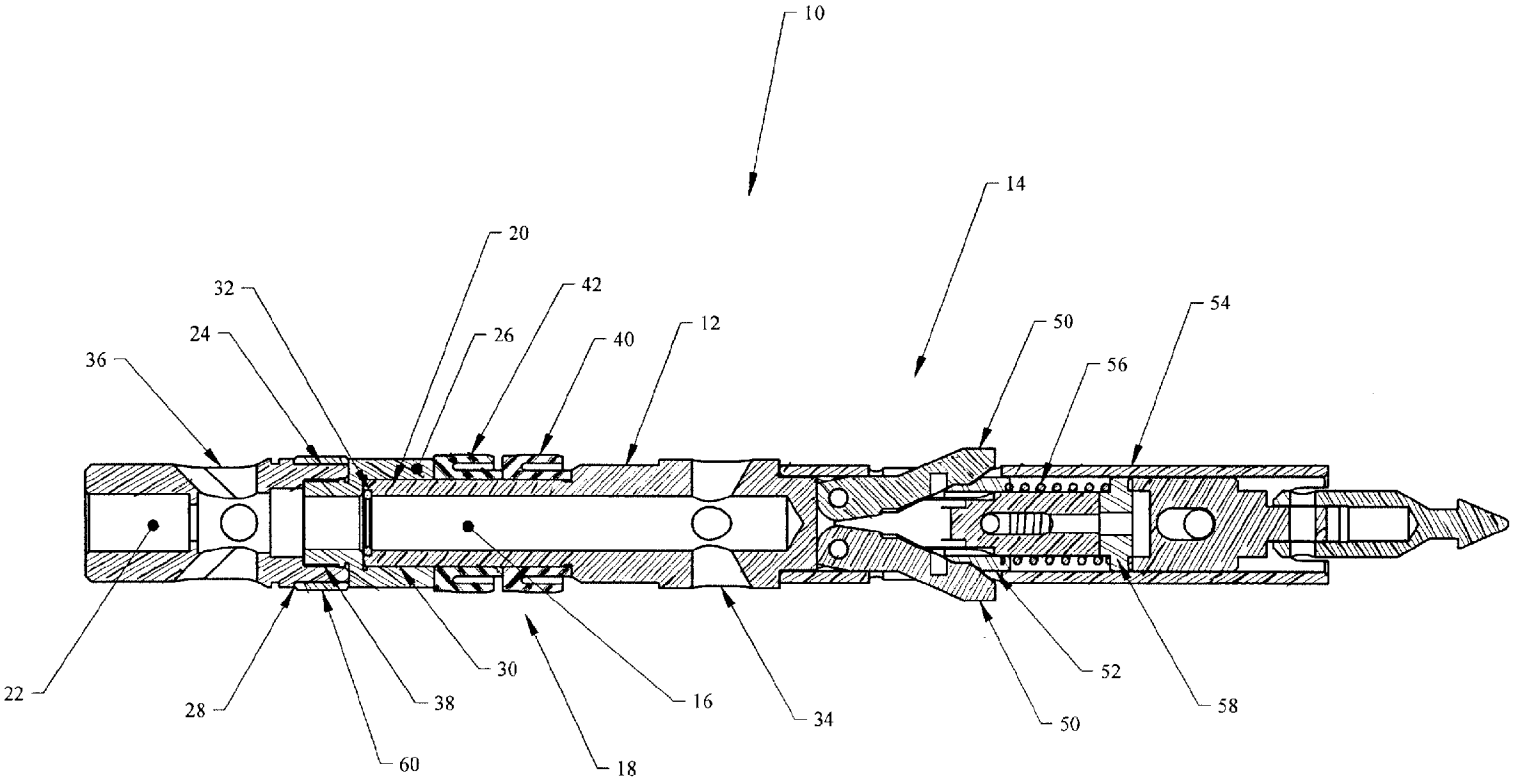
FIG. 2 is a cross-sectional side view of a head assembly according to another preferred embodiment of the present invention.

Preferably, for the embodiment shown in FIG. 2, the threaded coupler 26 comprises a recess for receiving a washer 32. The seal member 18 and stop washer 32 are removed from the head assembly 10 for a surface configuration. This is accomplished through the uncoupling of the coupler 26 from the upper and lower latch bodies. The recess in the coupler 26 accommodating the stop washer 32 is adapted such that the distance between the landing shoulder 60 and the latch assembly 14 remains the same whether the stop washer is installed or not.

Figure 3:
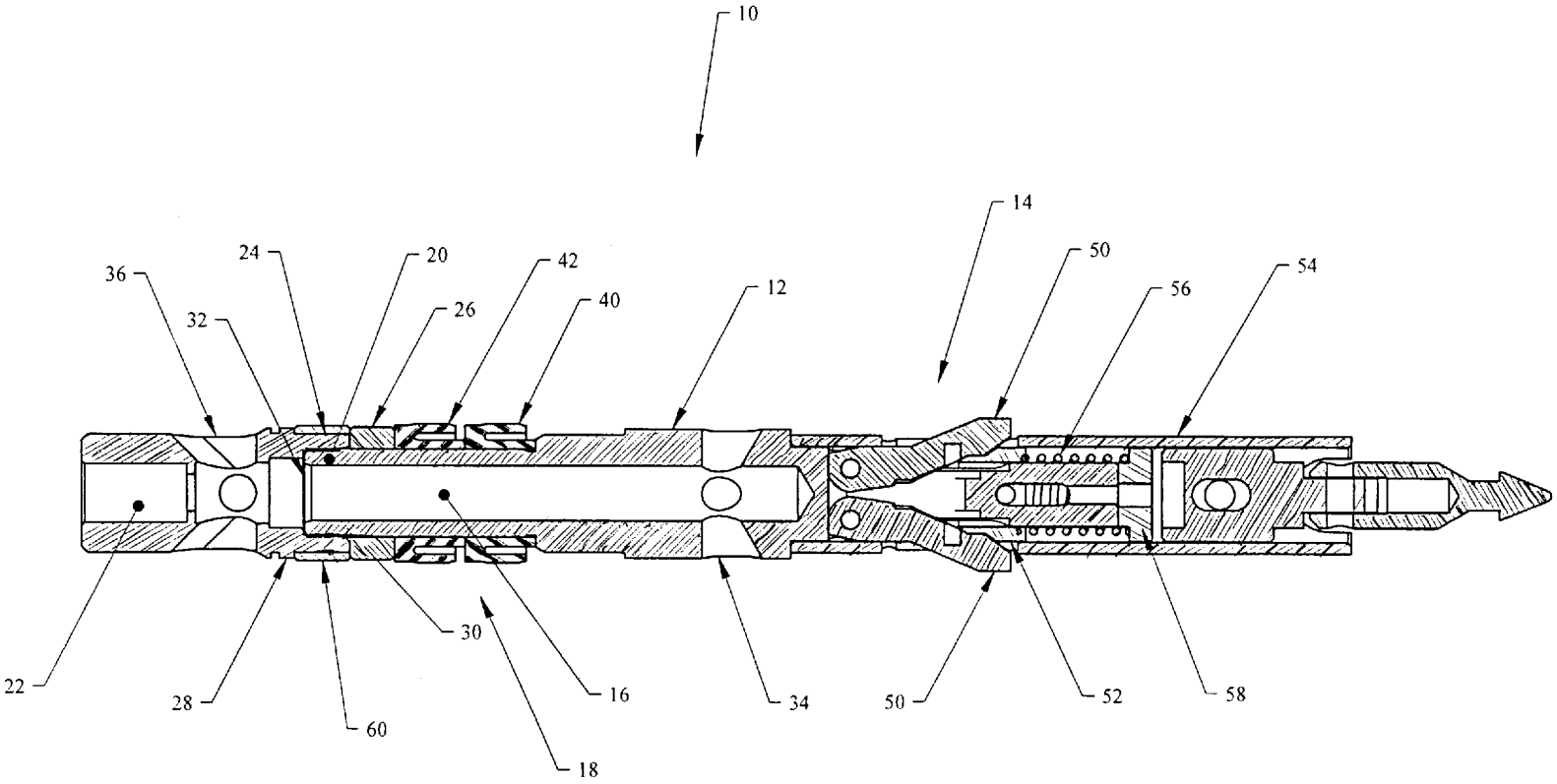
FIG. 3 is a cross-sectional side view of a head assembly according to another preferred embodiment of the present invention.

In the embodiment of the present invention shown in FIG. 3, the coupler 26 is a threaded locking nut 30. The locking nut 30 couples the upper latch body 12 to the lower latch body 22, and locks as well the landing shoulder 60 into position. The locking nut 30 thus also facilitates removal of the pumping seal member 18 and the landing shoulder 28 from the upper latch body 12. Therefore, the upper latch body 12 threads into the lower latch body 22 until it bottoms out, the locking nut 30 locking the latch bodies and the landing shoulder 60 into position. The distance between the landing shoulder 60 and the latch assembly 14 remains constant whether or not the seal member 18 is installed or not.

Preferably, when a locking nut 30 is used, the upper latch body 12 comprises a recess for receiving a washer 32. The seal member 18 and stop washer 32 are removed from the head assembly 10 for a surface configuration. This is accomplished through the uncoupling of the locking nut 30 from the upper and lower latch bodies. The recess in the upper latch body 12 accommodating the stop washer 32 is adapted such that the distance between the landing shoulder 60 and the latch assembly 14 remains the same whether the stop washer is installed or not.

Preferably, as shown in FIGS. 1 to 3, the upper latch body 12 further comprises a upper central bore and an upper port system 34 for fluidly connecting an outer surface of the upper latch body to the upper central bore, and the lower latch body 22 further comprises a lower central bore, in fluid communication with the upper central bore, and a lower port system 36 for fluidly connecting an outer surface of the lower latch body to the lower central bore.

Preferably, the upper port system 34 is positioned above the reduced diametric portion 16 of the upper latch body 12.

Preferably, the seal member 18 comprises at least one annular seal, first and second annular seals 40,42 as shown in FIGS. 1 to 3. The seals may be made of any resilient material and are adapted to prevent fluid circulation between the upper latch body 12 and the lower latch body 22 on the outer portions thereof when positioned within a drill string, and thus force fluids to pass through the central bore portions.

The latch assembly 14 in the upper latch body 12 may operate in accordance with various designs that are known the art. For example, FIG. 1 shows a latch assembly that comprises a pair of latches 50 operatively connected to a retracting case 52 which houses a latch piston 54 linked to a spring 56 and spring retainer 58.

All parts are consistent for both pump in/underground and surface configurations. The outer tubular components can thus remain the same for both pump in/underground and surface applications.

Although preferred embodiments of the present invention have been described in detail herein and illustrated in the accompanying drawing, it is to be understood that the invention is not limited to these precise embodiments and that various changes and modifications may be effected therein without departing from the scope of the present invention.

The invention claimed is:

1. A core barrel head assembly positionable within a drill string of a drilling apparatus, said core barrel head assembly comprising:

an upper latch body, said upper latch body comprising:

a latch assembly for engageably latching the drill string; and a reduced diametric portion below the latch assembly for receiving a seal member, said reduced diametric portion comprising a lower coupling portion on a bottom portion thereof;

a lower latch body comprising an upper coupling portion on a top portion thereof;

a landing shoulder; and a coupler for removably coupling the upper latch body to the lower latch body through the lower coupling portion and the upper coupling portion respectively, the coupler removably locking the upper latch body to the lower latch body and removably locking the landing shoulder with respect to the upper latch body, wherein the seal member is installable on the reduced diametric portion and removable from the reduced diametric portion upon uncoupling of the coupler from the upper latch body.

2. The core barrel head assembly according to claim 1, wherein the lower coupling portion and the upper coupling portion are threaded portions and the coupler is a threaded coupler having a reduced diametric portion interfacing with the lower latch body.

3. The core barrel head assembly according to claim 1, wherein the coupler comprises a recess for receiving a washer.

4. The core barrel head assembly according to claim 1, wherein the upper latch body further comprises a upper central bore and an upper port system for fluidly connecting an outer surface of the upper latch body to the upper central bore, and the lower latch body further comprises a lower central bore, in fluid communication with the upper central bore, and a lower port system for fluidly connecting an outer surface of the lower latch body to the lower central bore.

5. The core barrel head assembly according to claim 4, wherein the upper port system is positioned above the reduced diametric portion of the upper latch body.

6. The core barrel head assembly according to claim 1, wherein a distance between the landing shoulder and the latching assembly is constant irrespective of a presence or absence of the seal member and upon coupling of the upper latch body to the lower latch body with the coupler.

7. The core barrel head assembly according to claim 1, wherein the lower coupling portion and the upper coupling portion are threaded portions and the coupler is a threaded locking nut.

8. The core barrel head assembly according to claim 7, wherein the upper latch body comprises a recess for receiving a washer.

9. The core barrel head assembly according to claim 7, wherein the upper latch body further comprises a upper central bore and an upper port system for fluidly connecting an outer surface of the upper latch body to the upper central bore, and the lower latch body further comprises a lower central bore, in fluid communication with the upper central bore, and a lower port system for fluidly connecting an outer surface of the lower latch body to the lower central bore.

10. The core barrel head assembly according to claim 9, wherein the upper port system is positioned above the reduced diametric portion of the upper latch body.

11. The core barrel head assembly according to claim 7, wherein a distance between the landing shoulder and the latching assembly is constant irrespective of a presence or absence of the seal member and upon coupling of the upper latch body to the lower latch body with the coupler.

12. The core barrel head assembly according to claim 1, wherein the seal member comprises at least one annular seal.

* * * * *